US006842992B1

(12) United States Patent
Gitt

(10) Patent No.: US 6,842,992 B1
(45) Date of Patent: Jan. 18, 2005

(54) BUILDING WALL LAYOUT TOOL

(76) Inventor: Mark S. Gitt, 6170 12th Ave. NW., Naples, FL (US) 34119

( * ) Notice: Subject to any disclaimer, the term of this patent is extended or adjusted under 35 U.S.C. 154(b) by 0 days.

(21) Appl. No.: 10/704,084

(22) Filed: Nov. 7, 2003

(51) Int. Cl.[7] ..... E04G 21/18
(52) U.S. Cl. ..... 33/404; 33/1 LE
(58) Field of Search ..... 33/1 LE, 1 G, 33/404–410, 413

(56) References Cited

U.S. PATENT DOCUMENTS

| | | | | | |
|---|---|---|---|---|---|
| 1,594,836 | A | * | 8/1926 | Ingram | 33/408 |
| 1,852,446 | A | * | 4/1932 | Cattell | 33/407 |
| 2,834,112 | A | * | 5/1958 | Seagraves | 33/409 |
| 2,934,826 | A | * | 5/1960 | Klaum | 33/1 LE |
| 3,205,582 | A | * | 9/1965 | Andrews | 33/407 |
| 3,451,136 | A | * | 6/1969 | Shuttle, Jr. | 33/413 |
| 3,890,717 | A | | 6/1975 | Haun | |
| D261,238 | S | | 10/1981 | Pitt | |
| 4,338,728 | A | * | 7/1982 | Valead | 33/406 |
| 4,359,850 | A | * | 11/1982 | Sinkes | 33/406 |
| 4,924,579 | A | | 5/1990 | Berendsen | |
| 4,932,134 | A | * | 6/1990 | Meadows | 33/405 |
| 5,173,004 | A | | 12/1992 | Fahrenkrog | |
| 5,479,713 | A | * | 1/1996 | Wood | 33/407 |
| 5,657,548 | A | | 8/1997 | Kellar, Sr. | |
| 5,778,546 | A | * | 7/1998 | Williamson | 33/405 |
| 6,178,651 | B1 | * | 1/2001 | Yancey | 33/405 |
| 6,490,803 | B1 | | 12/2002 | Butters | |
| 2002/0073571 | A1 | * | 6/2002 | Brannon, Sr. | 33/413 |

* cited by examiner

*Primary Examiner*—G. Bradley Bennett
(74) *Attorney, Agent, or Firm*—The Livingston Firm; Edward M. Livingston; Angela M. Miller

(57) ABSTRACT

A building-wall-layout tool has a pair (29) of two line holders (1, 30, 31), each of which have spike legs (10, 12, 25) for being driven into ground material (13) proximate opposite ends (36, 42) of an intended wall (35) of an intended concrete slab for an intended building. Each of the line holders include a fastener section (2) and a handle section (3). The fastener section includes a fastener slot (6) extended from proximate a first side to proximate a second side of the fastener section. The fastener slot is articulated for receiving at least two line fasteners (7, 8) which are articulated for being slid in the fastener slot and affixed removably to sides of the fastener slot selectively intermediate the first side and the second side of the fastener section. The line fasteners are articulated for receiving and retaining indicator lines (40, 41) designedly. The first side of each of the line holders includes a first spike aperture (9) and a second spike aperture (11) that preferably have height adjusters (19, 20, 21, 22) for fastening and unfastening the spike legs at desired heights or distances of the line holders above the ground material for working conditions.

21 Claims, 8 Drawing Sheets

BUILDING WALL LAYOUT TOOL

This invention relates to laying out location of walls of buildings under construction and for positioning plumbing, electrical, air-conditioning, sewage and other conduits in relationship to the walls prior to pouring concrete slabs for the buildings.

A wide variety of batter boards and structural positioning tools are known for positioning walls and for positioning plumbing, electrical air-conditioning, sewage and other conduits in relationship to the walls of buildings prior to pouring concrete slabs and footers for the buildings. There are none, however, which have convenient two-way handles, wall-side-line adjusters, height adjusters and other advantages as taught by this invention.

Listed below for consideration is known related prior art:

| Patent Number | Inventor | Issue/Disclosure Date |
|---|---|---|
| U.S. Pat. No. 6,490,803 B1 | Butters | Dec. 10, 2002 |
| U.S. Pat. No. 5,778,546 | Williamson | Jul. 14, 1998 |
| U.S. Pat. No. 5,657,548 | Kellar, Sr. | Aug. 19, 1997 |
| U.S. Pat. No. 5,173,004 | Fahrenkrog | Dec. 22, 1992 |
| U.S. Pat. No. 4,924,579 | Berendsen | May 15, 1990 |
| U.S. Pat. No. Des. 261,238 | Pitt | Oct. 13, 1981 |
| U.S. Pat. No. 3,890,717 | Haun | Jun. 24, 1975 |
| U.S. Pat. No. 4,932,134 | Meadows | Jun. 12, 1990 |

SUMMARY OF THE INVENTION

Objects of patentable novelty and utility taught by this invention include providing:

- line holders which can be positioned conveniently and accurately in ground proximate intended walls and conduits of buildings;
- convenient, quick and accurate positioning of indicator lines on the line holders for indicating opposite sides of walls intermediate pairs of the line holders;
- holder spikes that can be driven easily into, hold fast in and be removed easily from ground having foreseeable consistencies proximate building sites;
- height adjusters that allow convenient adjustment of height of the line holders as may be helpful for progressive stages of construction; and
- a building-wall-layout tool which is sufficiently advantageous and convenient for overcoming inaccuracy of makeshift and time-consuming use of batter boards which traditionally have been scrap boards battered into the ground proximate intended walls and then tying string between the batter boards to indicate where to position water, electrical, gas and sewage conduits in positional relationship to the intended walls.

This invention accomplishes these and other objectives with a building-wall-layout tool having a pair of two line holders, each of which have spike legs for being driven into ground proximate opposite sides of an intended wall section of an intended concrete slab for an intended building. Each of the line holders include a fastener section and a handle section. The fastener section includes a fastener slot extended from proximate a first side to proximate a second side of the fastener section. The fastener slot is articulated for receiving at least two line fasteners which are articulated for being slid in the fastener slot and affixed removably to sides of the fastener slot selectively intermediate the first side and the second side of the fastener section. The line fasteners are articulated for receiving and retaining indicator line designedly. The first side of each of the line holders includes a first spike aperture having a spike fastener for receiving a first spike leg and for fastening and unfastening the first spike leg at desired positioning in the first spike aperture. The second side of each of the line holders includes a second spike aperture having a spike fastener for receiving a second spike leg and for fastening and unfastening the second spike leg at desired positioning in the second spike aperture.

The above and other objects, features and advantages of the present invention should become even more readily apparent to those skilled in the art upon a reading of the following detailed description in conjunction with the drawings wherein there is shown and described illustrative embodiments of the invention.

BRIEF DESCRIPTION OF DRAWINGS

This invention is described by appended claims in relation to description of a preferred embodiment with reference to the following drawings which are explained briefly as follows:

DESCRIPTION OF PREFERRED EMBODIMENT

Figure 1:
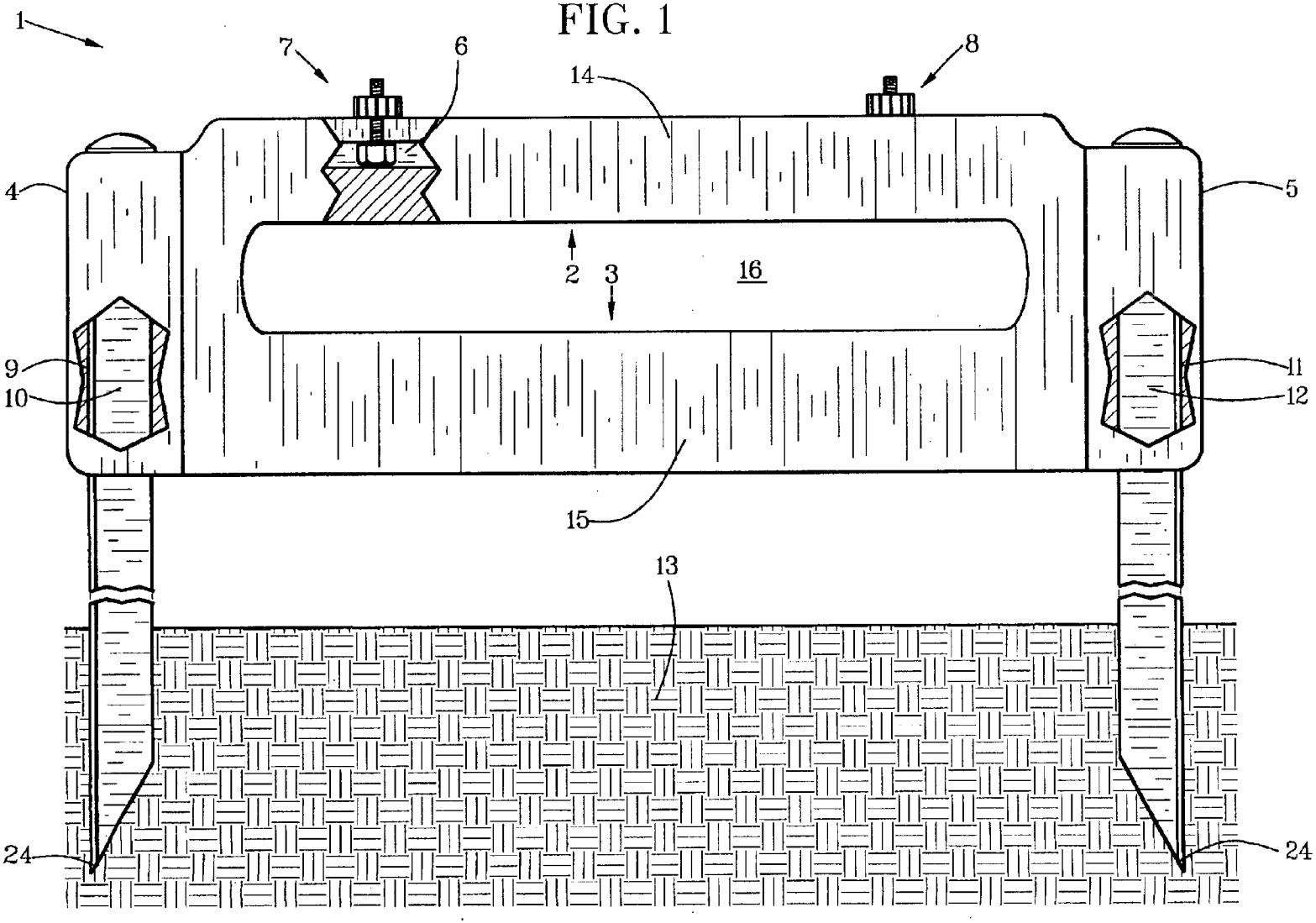
FIG. 1 is a partially cutaway front view of a line holder having a top fastener section and a bottom handle section.
Figure 2:
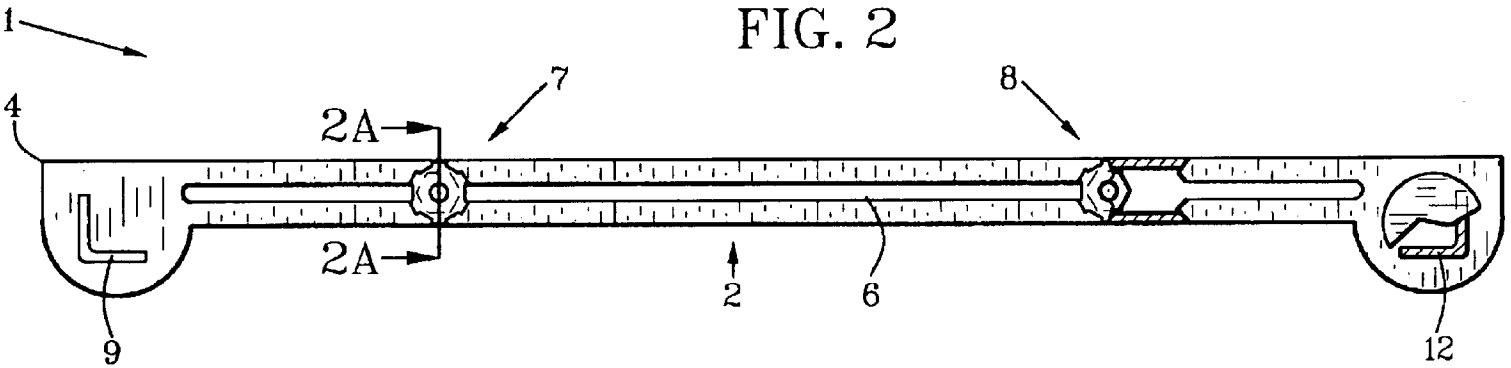
FIG. 2 is a partially cutaway top view of the FIG. 1 illustration.

Listed numerically below with reference to the drawings are terms used to describe features of this invention. These terms and numbers assigned to them designate the same features throughout this description.

1. Line holder
2. Fastener section
3. Handle section
4. First side
5. Second side
6. Fastener slot
7. First line fastener
8. Second line fastener
9. First spike aperture
10. First spike leg
11. Second spike aperture
12. Second spike leg
13. Ground material
14. Top fastener section
15. Bottom handle section
16. Foot space
17. Side handle
18. Side fastener section
19. First set screw
20. Second set screw
21. First adjustment knob
22. Second adjustment knob
23. Beam-wall axes
24. Angular points
25. Cylindrical spikes
26. Metal lining
27. Secondary support sleeve
28. Support stake
29. Pair
30. First line holder
31. Second line holder
32. First reference point
33. Second reference point
34. First side of intended wall
35. Intended wall
36. First end of intended wall
37. First design distance
38. Second design distance
39. Wal-thickness distance
40. First line
41. Second line
42. Second end of intended wall
43. Slab area
44. Elongate spike apertures
45. Square spike apertures
46. Right-angle spike legs Referring to FIGS. 1–5, a building-wall-layout tool has at least one line holder 1 which includes a fastener section 2 and a handle section 3 which are separated predeterminedly intermediate proximate a first side 4 and a second side 5 of the line holder 1. The fastener section 2 has a fastener slot 6 extended from proximate a first side to proximate a second side of the fastener section 2.

The fastener slot 6 is articulated for receiving at least two line fasteners predeterminedly for being slid in the fastener slot 6 and affixed removably to edges of the fastener slot 6 selectively intermediate the first side and the second side of the fastener section 2. The fastener slot 6 has a length predeterminedly longer than a width of intended walls for receiving a first line fastener 7 proximate a first side of a thickness range of the intended walls and for receiving a second line fastener 8 proximate a second side of the thickness range of the intended walls;

The first side 4 of the line holder includes a first spike aperture 9 that is articulated for receiving a first spike leg 10 predeterminedly in a vertical orientation. The second side 5 of the line holder 1 includes a second spike aperture 11 that is articulated for receiving a second spike leg 12 predeterminedly in a vertical orientation.

Figure 10:
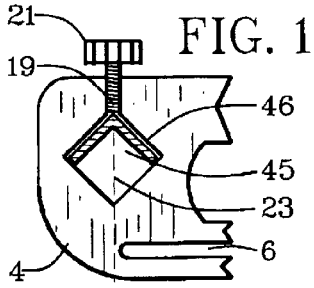
FIG. 10 is the FIG. 9 illustration with the square spike-leg aperture is oriented at approximately 45 degrees from the fastener slot.
Figure 11:
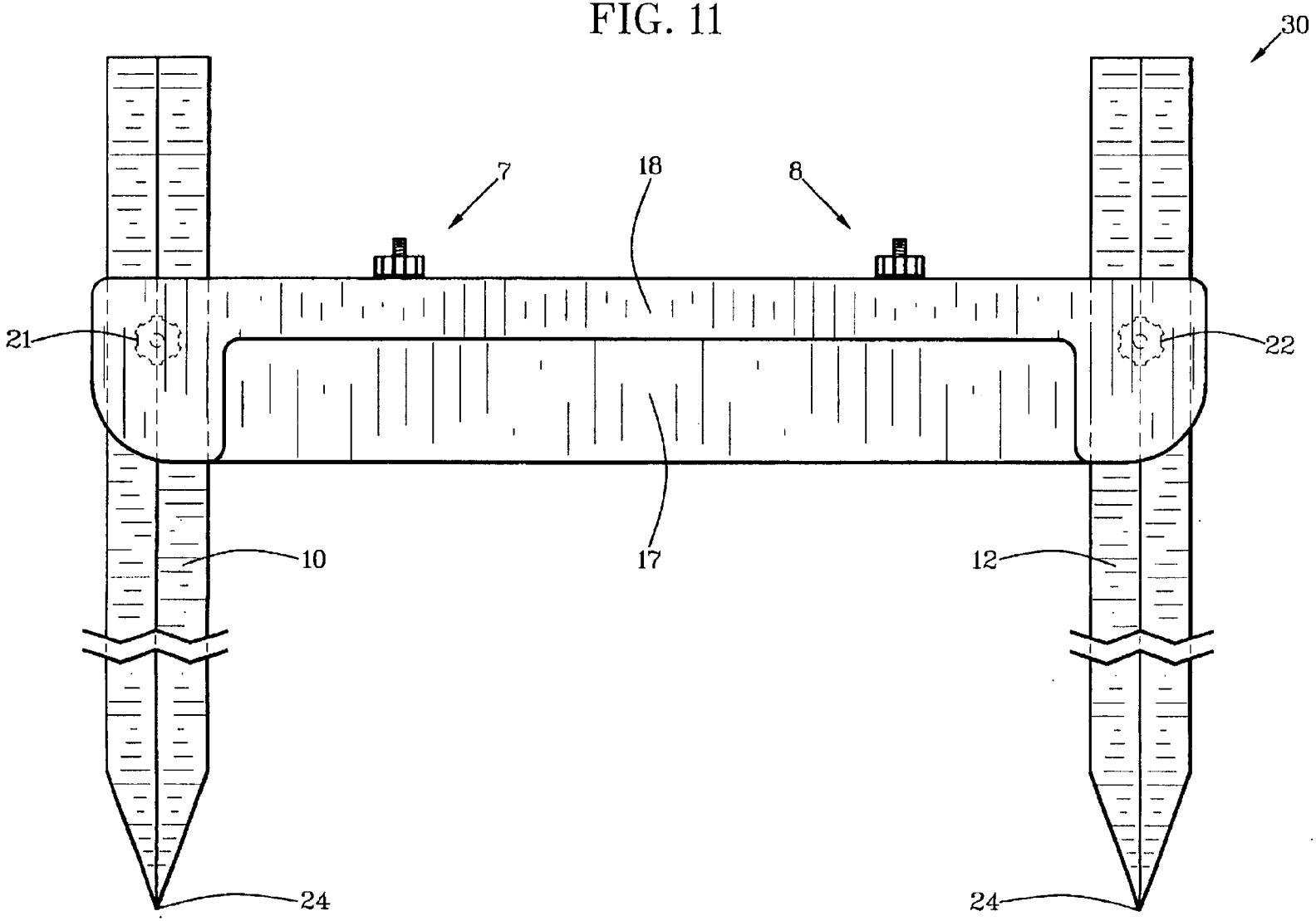
FIG. 11 is a front view of a first line holder with the side handle, the side fastener section and wide-angled spike legs.
Figure 12:
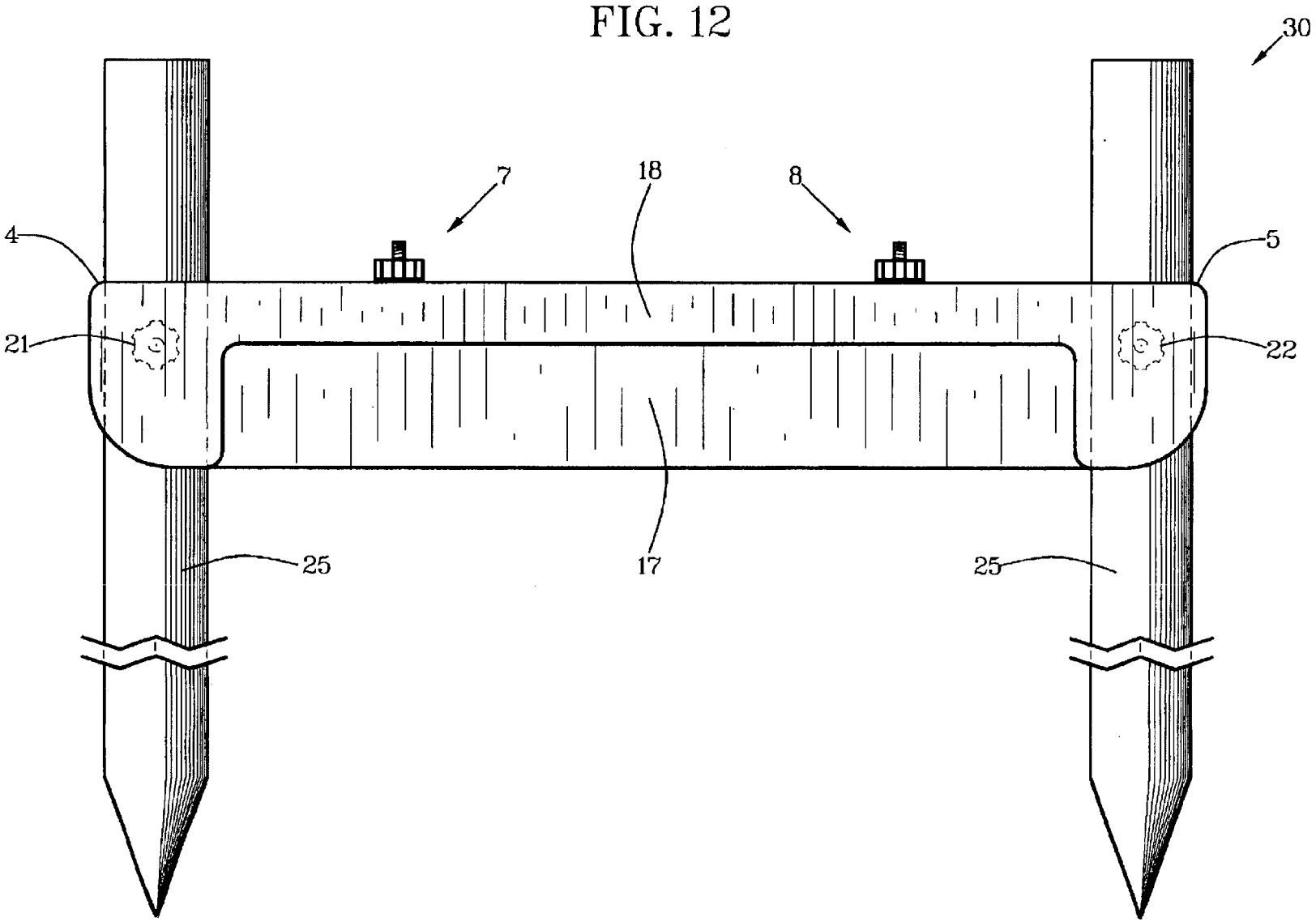
FIG. 12 is the FIG. 11 illustration with cylindrical spike legs.

The first spike leg 10 and the second spike leg 12 are preferably angled beams as shown in FIGS. 1–2, 5–11 and 13, but can be cylindrical as shown in FIG. 12. They also can be angled predeterminedly as shown with right angles in FIGS. 1–2, 5 and 9–10 or wide-angled as shown in FIGS. 6–8, 11 and 13.

Figure 8:
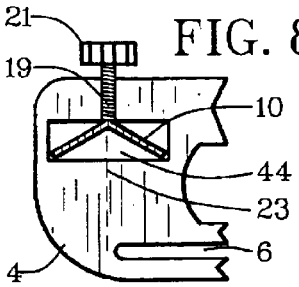
FIG. 8 is a fragmentary end view of a line holder having a wide-angled spike leg in a rectangular spike-leg aperture and having an arrester set screw and arrester knob.
Figure 9:
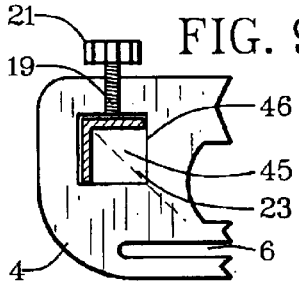
FIG. 9 is a fragmentary end view of line holder having a right-angled spike leg in a square spike-leg aperture that is oriented orthogonally to the fastener slot and has an arrester set screw and arrester knob.

The first spike aperture 9 and the second spike aperture 11 can be shaped to match a shape, orientation and size of the spike legs 10 and 12 as shown in FIGS. 1–2, 5–6 and 13. Optionally, elongate spike apertures 44 can be provided for receiving wide-angled spike legs 10 as shown in FIG. 8. Square spike apertures 45 oriented predeterminedly can be provided for receiving right-angle spike legs 46 as shown in FIGS. 9–10.

The wide-angled spike legs 10 and 12 shown in FIGS. 6–8, 11 and 13 with beam-wall axes 23 perpendicular to the fastener slot 6 are more stable, lighter per support strength and lighter per holder material. With height adjustment, they can be driven selectively into ground material 13 for adaptability to ground softness and consistency.

Figure 13:
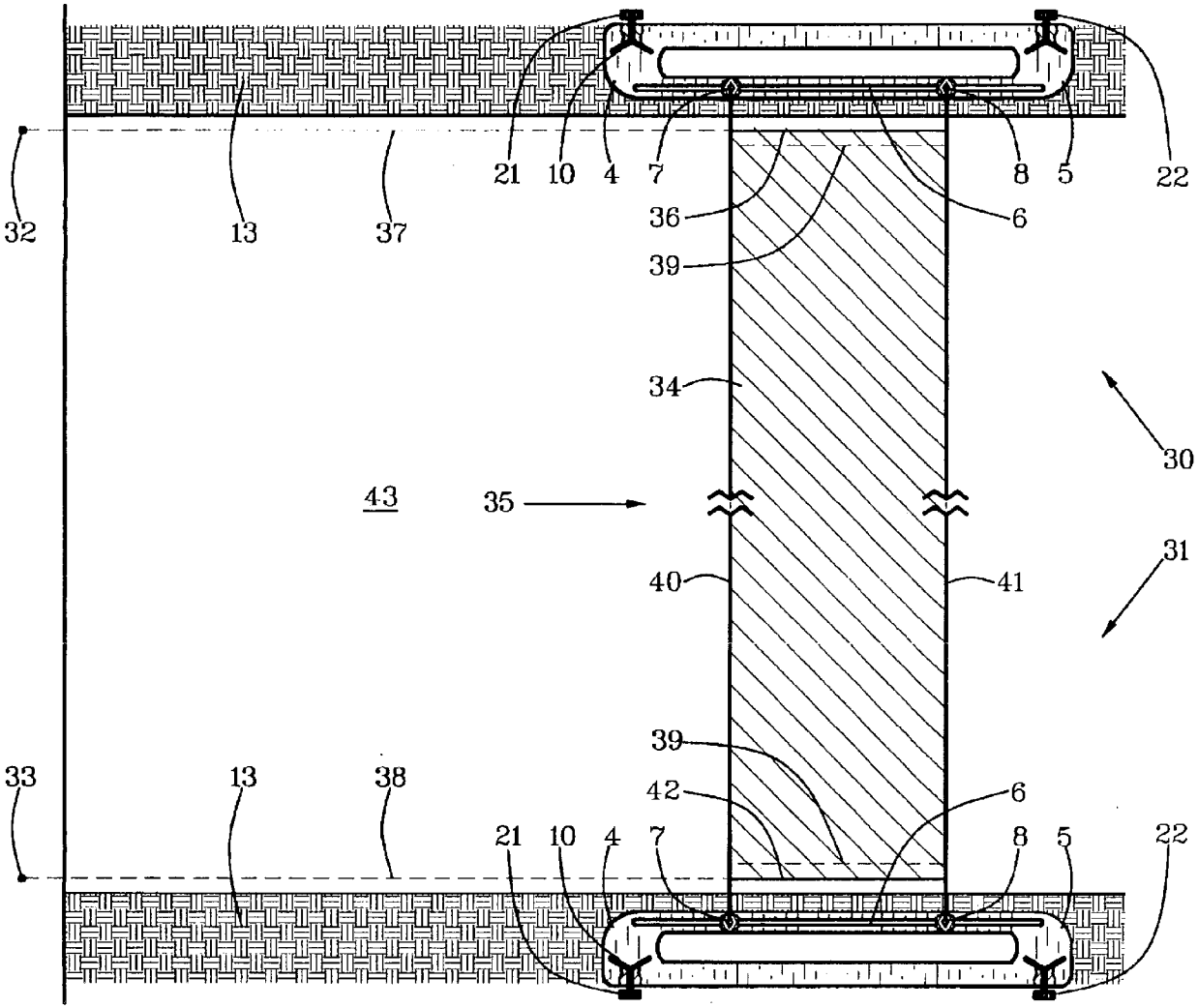
FIG. 13 is a top plan view of a pair of line holders in use-method relationship to a slab area for laying out an intended wall.

The handle section 3 is articulated for hand-carrying the line holder 1, for accurately and conveniently positioning the line holder 1 proximate the intended walls 35, shown in FIG. 13, and any intended conduits, for positioning the first spike leg 10 and the second spike leg 12 in ground material 13 proximate edges of an intended concrete slab area 43, shown in FIG. 13, and for removing the line holder 1 from the ground material 13 selectively without undesired contact with any line fasteners in the fastener slot 6 and without undesired contact with the fastener section 2.

As shown in FIGS. 6–13, the handle section 3 can include atop fastener section 14 and a bottom handle section 15 that is parallel to and vertically below the top fastener section 14. Further included can be a foot space 16 intermediate the top fastener section 14 and the bottom handle section 15 for positioning a user's foot and shoe for foot-pressing the bottom handle section 15 to press the line-holder 1 into the ground material 13.

As shown further in FIGS. 6–13, the handle section 3 can include a side handle 17 that is parallel to and juxtaposed predeterminedly beside a side fastener section 18.

As shown in FIGS. 5–13, the first spike aperture 9 and the first spike leg 10 can be articulated for predetermined sliding of the first spike leg 10 in the first spike aperture 9 and the second spike aperture 11 and the second spike leg 12 can be articulated for predetermined sliding of the second spike leg 12 in the second spike aperture 11 to adjust line-holder distance above the ground material 13. For this sliding option., at least one spike arrester for predeterminedly arresting sliding of the first spike leg 10 in the first spike aperture 9 and for predeterminedly arresting sliding of the second spike leg 12 in the second spike aperture 11. The spike arrester can include a first set screw 19 that is set-screwed through a wall of the first side 4 for fastening abutment against the first spike leg 10 and the spike arrester includes a second set screw 20 that is set-screwed through a wall of the second side 5 for fastening abutment against the second spike leg 12.

The first set screw 19 can include a first adjustment knob 21 and the second set screw 20 can include a second adjustment knob 22.

Figure 7:
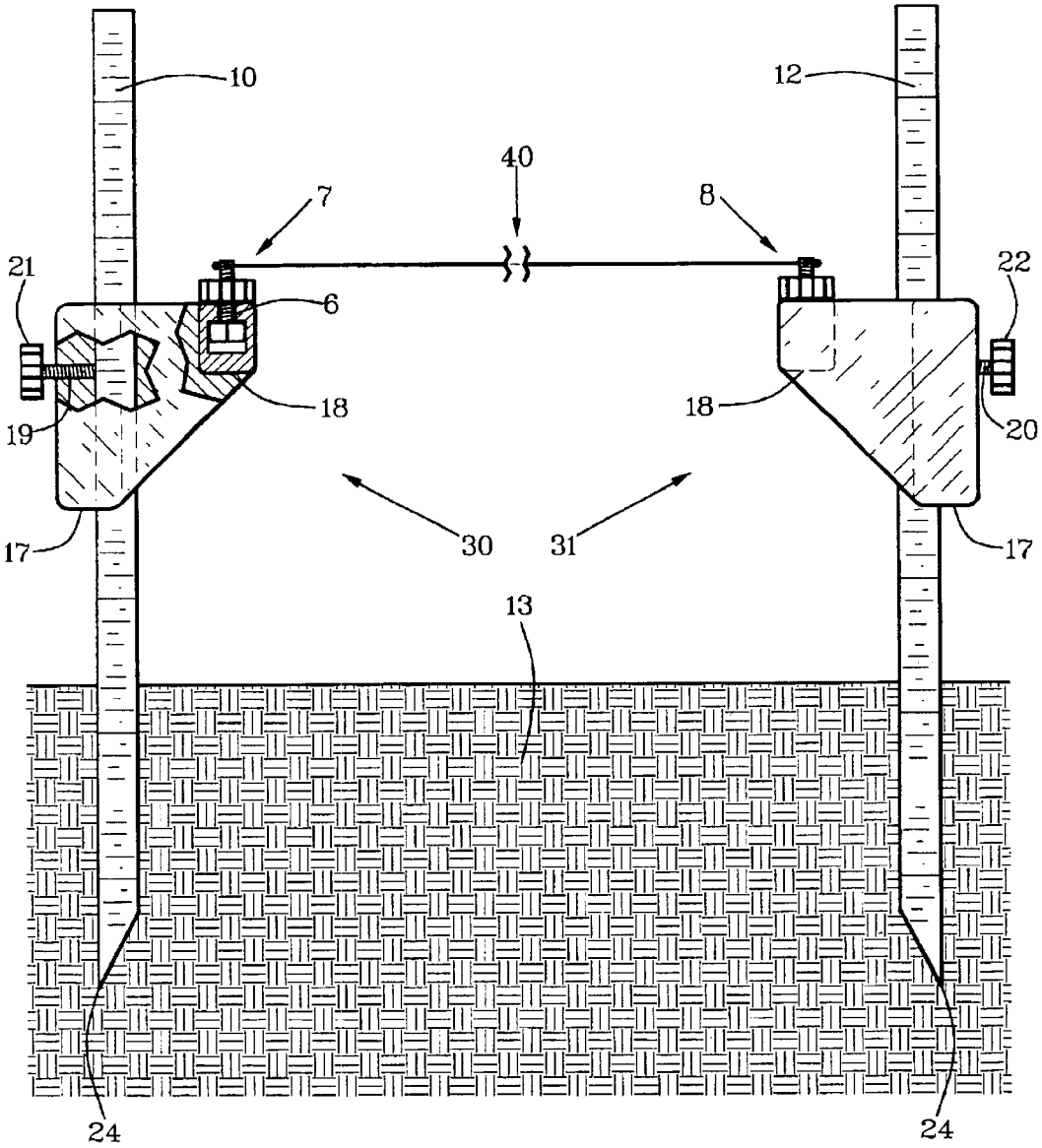
FIG. 7 is a partially cutaway side view of the FIG. 6 illustration.

As shown in FIGS. 1, 7 and 11, angular points 24 on bottoms of the first spike leg 10 and the second spike leg 12 can be provided for ease of entry into the ground material 13.

As shown in FIG. 12, the first spike leg 10 and the second spike leg 12 can include cylindrical spikes 25 in cylindrical spike apertures, but are not preferred for most applications.

The fastener section 2 and the handle section 3 are preferably made of a predeterminedly durable plastic.

Figure 4:
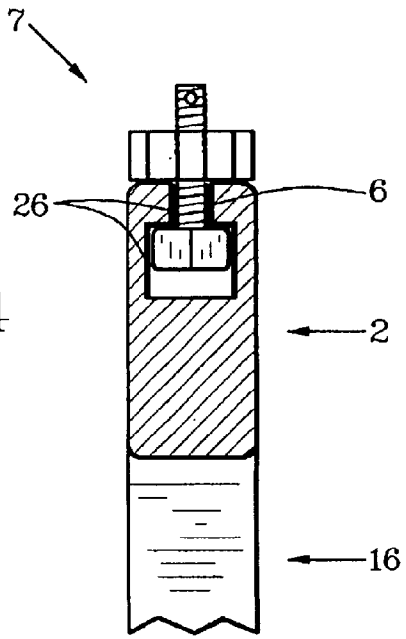
FIG. 4 is an enlarged top portion of the FIG. 3 illustration.
Figure 3:
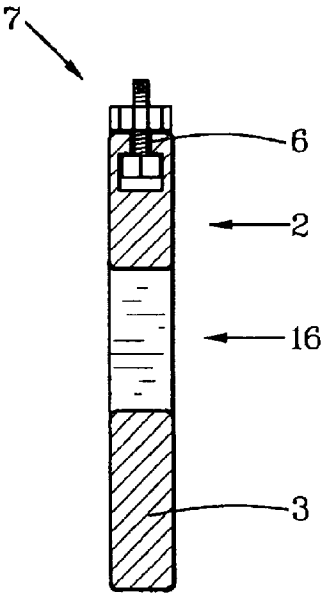
FIG. 3 is a section view taken through section 2A of FIG. 2.

As shown in FIG. 4, metal lining 26 can be provided on surfaces of the fastener slot 6 for aiding durability with sliding contact of the first line fastener 7 and the second line fastener 8 with the edges of the fastener slot 6.

Figure 5:
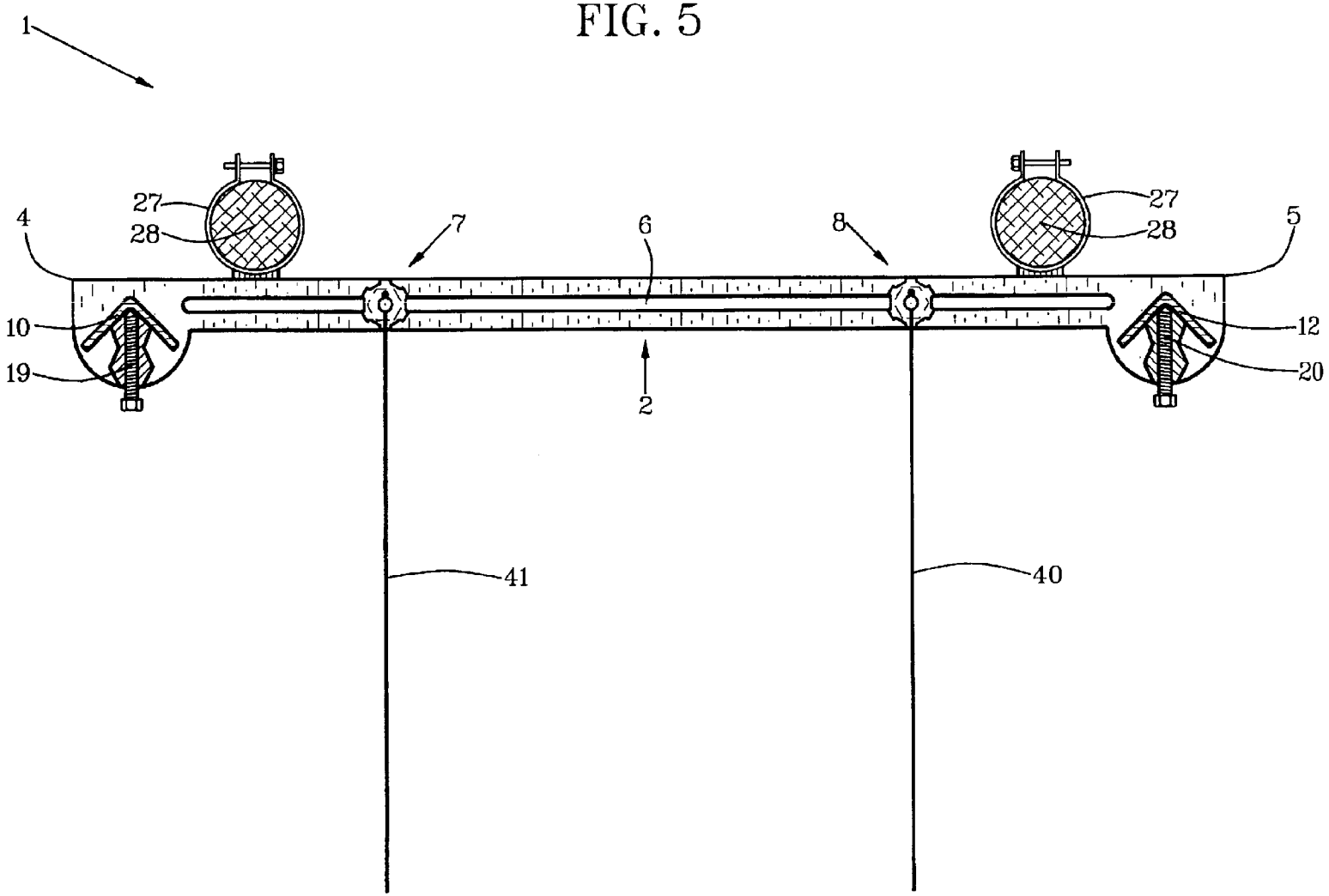
FIG. 5 is the FIG. 2 illustration with addition of a supplementary support system, a spike arrester and lines on line fasteners.
Figure 6:
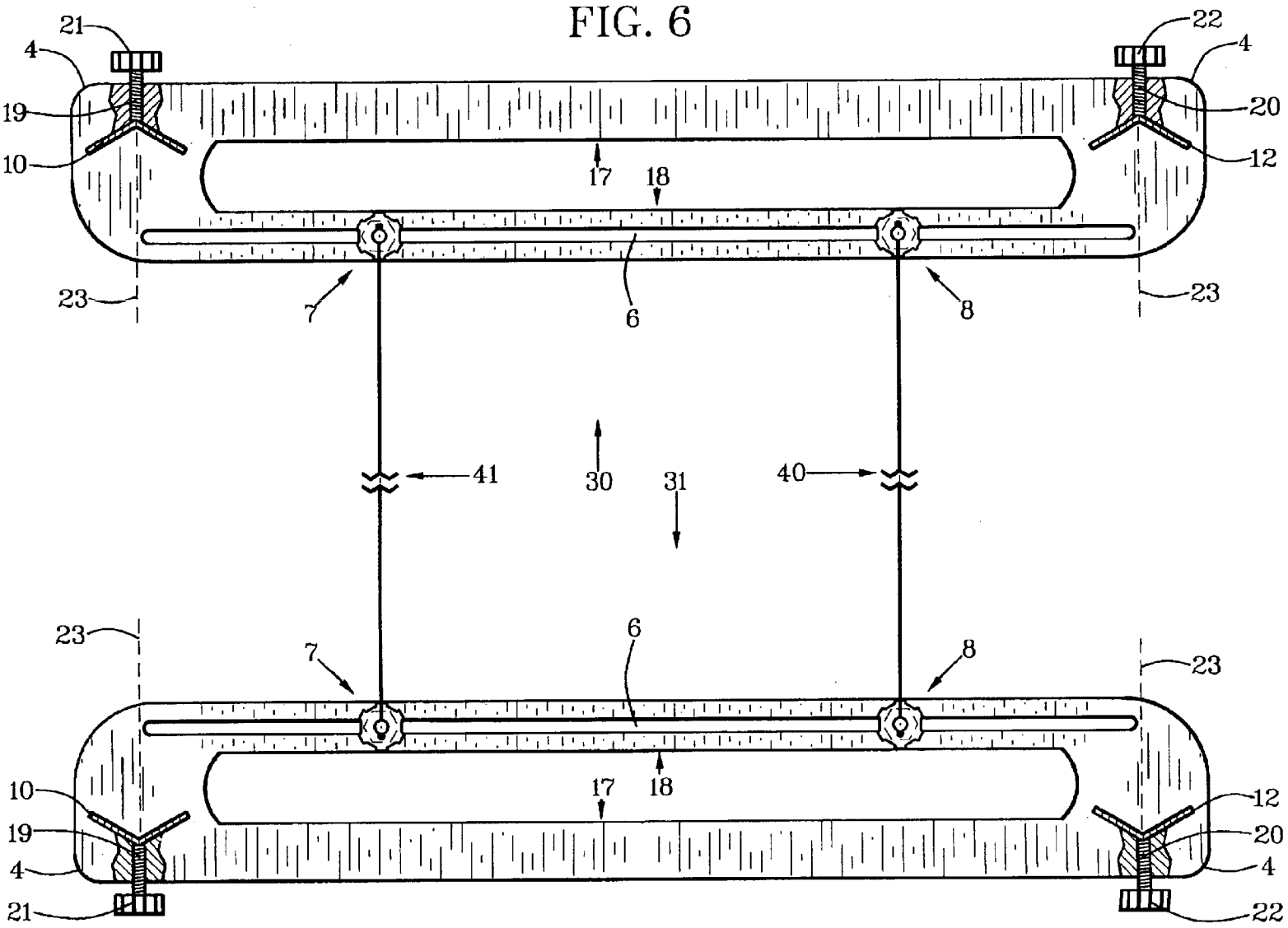
FIG. 6 is a partially cutaway top view of oppositely disposed line holders having side handles and side fastener sections.

As shown in FIG. 5, a secondary support system having at least one secondary support sleeve 27 attached to the line holder 1 for retaining a support stake 28 can be provided for extra support in ground material 13 that is unusually soft.

The line holder 1 has a preferable width of sixteen inches intermediate the first side 4 and the second side 5.

Referring to FIGS. 1–13 for description of operative use, a pair 29 of two line holders, a first line holder 30 and a second line holder 31, each include the fastener section 2 and the handle section 3 which are separated predeterminedly intermediate proximate the first side 4 and the second side 5 of the line holder 1. The fastener section 2 has the fastener slot 6 extended from predeterminedly proximate a first side to proximate a second side of the fastener section 2. The fastener slot 6 is articulated for receiving at least two line fasteners predeterminedly for being slid in the fastener slot 6 and affixed removably to edges of the fastener slot 6 selectively intermediate the first side and the second side of the fastener section 2.

The fastener slot 6 has a length predeterminedly longer than a width of intended walls 35 for receiving the first line fastener 7 proximate a first side of a thickness range of the intended walls 35 and for receiving the second line fastener 8 proximate a second side of the thickness range of the intended walls 35.

The first side 4 of the line holder includes the first spike aperture 9 that is articulated for receiving the first spike leg 10 predeterminedly in a vertical orientation. The second side 5 of the line holder 1 includes the second spike aperture 11 that is articulated for receiving the second spike leg 12 predeterminedly in a vertical orientation.

The handle section 3 is articulated for hand-carrying the line holder 1, for accurately and conveniently positioning the line holder 1 proximate the intended walls 35 and any intended conduits, for positioning the first spike leg 10 and the second spike leg 12 in ground material 13 proximate edges of an intended concrete slab and for removing the line holder 1 from the ground material 13 selectively without undesired contact with any line fasteners in the fastener slot 6 and without undesired contact with the fastener section 2.

A method has the following steps for using the pair 29 of the line holders of claim 19:

affixing a first line holder 30 in ground material 13 with a first side 4 of the first line holder 30 being at a proximate distance of a first side 34 of a first end 36 of an intended wall 35 from a first reference point 32;

affixing a second line holder 31 in ground material 13 with a first side 4 of the second line holder 31 at a proximate distance of the first side 34 of a second end 42 of the intended wall 35 from a second reference point 33;

accurately positioning the first line fastener 7 on the fastener section 2 of the first line holder 30 at a first design distance 37 from the first reference point 32;

accurately positioning the first line fastener 7 on the fastener section 2 of the second line holder 31 at a second design distance 38 from the second reference point 33;

accurately positioning the second line fastener 8 on the fastener section 2 of the first line holder 30 at a wall-thickness distance 39 from the first line fastener 7;

accurately positioning the second line fastener 8 on the fastener section 2 of the second line holder 31 at the wall-thickness distance 39 from the first line fastener 7;

positioning a first line 40 tautly intermediate the first line fastener 7 on the first line holder 30 and the first line fastener 7 on the second line holder 31; and positioning a second line 41 tautly intermediate the second line fastener 8 on the first line holder 30 and the second line fastener 8 on the second line holder 31 for layout positioning of the intended wall 35.

The method of claim 20 can be adapted for height adjustment of the line holders 30 and 31 which include height adjustment by including an additional step of adjusting distance of the first line holder 30 and the second line holder 31 vertically above the ground material 13 for structural work selectively.

A new and useful building-wall-layout tool having been described, all such foreseeable modifications, adaptations, substitutions of equivalents, mathematical possibilities of combinations of parts, pluralities of parts, applications and forms thereof as described by the following claims and not precluded by prior art are included in this invention.

What is claimed is:

1. A building-wall-layout tool comprising:

at least one line holder which includes a fastener section and a handle section which are separated predeterminedly intermediate proximate a first side and a second side of the line holder;

the fastener section having a fastener slot extended from proximate a first side to proximate a second side of the fastener section;

the fastener slot being articulated for receiving at least two line fasteners predeterminedly for being slid in the fastener slot and affixed removably to edges of the fastener slot selectively intermediate the first side and the second side of the fastener section;

the fastener slot having a length predeterminedly longer than a width of intended walls for receiving a first line fastener proximate a first side of a thickness range of the intended walls and for receiving a second line fastener proximate a second side of the thickness range of the intended walls;

the first side of the line holder includes a first spike aperture that is articulated for receiving a first spike leg predeterminedly in a vertical orientation;

the second side of the line holder including a second spike aperture that is articulated for receiving a second spike leg predeterminedly in a vertical orientation; and the handle section being articulated for hand-carrying the line holder, for accurately and conveniently positioning the line holder proximate the intended walls and any intended conduits, for positioning the first spike leg and the second spike leg in ground material proximate edges of an intended concrete slab and for removing the line holder from the ground material selectively without undesired contact with any line fasteners in the fastener slot and without undesired contact with the fastener section.

2. The building-wall-layout tool of claim 1 wherein:

the handle section includes a top fastener section and a bottom handle section that is parallel to and vertically below the top fastener section.

3. The building-wall-layout tool of claim 2 and further comprising:

a foot space intermediate the top fastener section and the bottom handle section for positioning a user's foot and shoe for foot-pressing the bottom handle section to press the line-holder 1 into the ground material.

4. The building-wall-layout tool of claim 1 wherein:

the handle section includes a side handle that is parallel to and juxtaposed predeterminedly beside a side fastener section.

5. The building-wall-layout tool of claim 1 wherein:

the first spike aperture includes a predeterminedly angled aperture;

the first spike leg includes a predetermined angle beam;

the second spike aperture includes a predeterminedly angled aperture; and the second spike leg includes a predetermined angle beam.

6. The building-wall-layout tool of claim 5 wherein:

the first spike aperture and the first spike leg are articulated for predetermined sliding of the first spike leg in the first spike aperture; and the second spike aperture and the second spike leg are articulated for predetermined sliding of the second spike leg in the second spike aperture.

7. The building-wall-layout tool of claim 6 and further comprising:

at least one spike arrester for predeterminedly arresting sliding of the first spike leg in the first spike aperture and for predeterminedly arresting sliding of the second spike leg in the second spike aperture.

8. The building-wall-layout tool of claim 7 wherein:

the spike arrester includes a first set screw that is set-screwed through a wall of the first side for fastening abutment against the first spike leg; and the spike arrester includes a second set screw that is set-screwed through a wall of the second side for fastening abutment against the second spike leg.

9. The building-wall-layout tool of claim 8 wherein:

the first set screw includes a first arrester knob; and the second set screw includes a second arrester knob.

10. The building-wall-layout tool of claim 1 wherein:

the first spike leg includes angle-beam legs that are angled apart at select beam-wall angles in the first angle-beam apertures;

the second spike leg includes angle-beam legs that are angled apart at select beam-wall angles in the second angle-beam apertures; and the select beam-wall angles include beam-wall axes midway between beam walls of the angle-beam legs; and the beam-wall axes are oriented predeterminedly.

11. The building-wall-layout tool of claim 10 wherein:

the select beam-wall angles are predeterminedly less that 180 degrees and predeterminedly greater than 90 degrees; and the beam-wall axes are perpendicular to the fastener section.

12. The building-wall-layout tool of claim 11 wherein:

the first spike aperture and the first spike leg are articulated for predetermined sliding of the first spike leg in the first spike aperture;

the second spike aperture and the second spike leg are articulated for predetermined sliding of the second spike leg in the second spike aperture;

the at least one spike arrester for predeterminedly arresting sliding of the first spike leg in the first spike aperture and for predeterminedly arresting sliding of the second spike leg in the second spike aperture;

the spike arrester includes the first set screw that is set-screwed through a wall of the first side for fastening abutment against the first spike leg;

the spike arrester includes the second set screw that is set-screwed through a wall of the second side for fastening abutment against the second spike leg;

the first set screw includes the first arrester knob;

the second set screw includes the second arrester knob; and the first set screw is set-screwed through a wall of the first side and the second set screw is set-screwed through a wall of the second side which are oppositely disposed from the beam-wall axes.

13. The building-wall-layout tool of claim 1 and further comprising:

angular points on bottoms of the first spike leg and the second spike leg.

14. The building-wall-layout tool of claim 1 wherein:

the first spike leg and the second spike leg include cylindrical spikes in cylindrical spike apertures.

15. The building-wall-layout tool of claim 1 wherein:

the fastener section and the handle section are made of a predeterminedly durable plastic.

16. The building-wall-layout tool of claim 11 and further comprising:

metal lining on surfaces of the fastener slot for aiding durability with sliding contact of the first line fastener and the second line fastener with the edges of the fastener slot.

17. The building-wall-layout tool of claim 1 and further comprising:

a secondary support system having at least one secondary support sleeve attached to the line holder for retaining a support stake for extra support in ground material that is unusually soft.

18. The building-wall-layout tool of claim 1 wherein:

the line holder has a preferable width of sixteen inches intermediate the first side and the second side.

19. A building-wall-layout tool comprising:

a pair of two line holders being a first line holder and a second line holder which include the fastener section and the handle section which are separated predeterminedly intermediate proximate the first side and the second side of the line holder;

the fastener section having the fastener slot extended from predeterminedly proximate a first side to proximate a second side of the fastener section;

the fastener slot being articulated for receiving at least two line fasteners predeterminedly for being slid in the fastener slot and affixed removably to edges of the fastener slot selectively intermediate the first side and the second side of the fastener section;

the fastener slot having a length predeterminedly longer than a width of intended walls for receiving the first line fastener proximate a first side of a thickness range of the intended walls and for receiving the second line fastener proximate a second side of the thickness range of the intended walls;

the first side of the line holder includes a first spike aperture that is articulated for receiving a first spike leg predeterminedly in a vertical orientation;

the second side of the line holder including a second spike aperture that is articulated for receiving a second spike leg predeterminedly in a vertical orientation; and the handle section being articulated for hand-carrying the line holder, for accurately and conveniently positioning the line holder proximate the intended walls and any intended conduits, for positioning the first spike leg and the second spike leg in ground material proximate edges of an intended concrete slab and for removing the line holder from the ground material selectively without undesired contact with any line fasteners in the fastener slot and without undesired contact with the fastener section.

20. A method comprising the following steps for using the pair of the line holders of claim 19:

affixing a first line holder in ground material with a first side of the first line holder being at a proximate distance of a first side of a first end of an intended wall from a first reference point;

affixing a second line holder in ground material with a first side of the second line holder at a proximate distance of the first side of a second end of the intended wall from a second reference point;

accurately positioning the first line fastener on the fastener section of the first line holder at a first design distance from the first reference point;

accurately positioning the first line fastener on the fastener section of the second line holder at a second design distance from the second reference point;

accurately positioning the second line fastener on the fastener section of the first line holder at a wall-thickness distance from the first line fastener;

accurately positioning the second line fastener on the fastener section of the second line holder at the wall-thickness distance from the first line fastener;

positioning a first line tautly intermediate the first line fastener on the first line holder and the first line fastener on the second line holder; and positioning a second line tautly intermediate the second line fastener on the first line holder and the second line fastener on the second line holder for layout positioning of the intended wall.

21. The method of claim 20 wherein:

the first line holder and the second line holder include height adjustment on the first spike leg and on the second spike leg and including an additional step of adjusting distance of the first line holder and the second line holder vertically above the ground material for structural work selectively.

* * * * *